US006247768B1

(12) United States Patent
Yamaguchi

(10) Patent No.: US 6,247,768 B1
(45) Date of Patent: Jun. 19, 2001

(54) PROTECTIVE SHEET MOUNT STRUCTURE FOR DISPLAY

(75) Inventor: Masahiro Yamaguchi, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/570,031

(22) Filed: May 12, 2000

Related U.S. Application Data

(63) Continuation of application No. 09/233,981, filed on Jan. 20, 1999, now Pat. No. 6,152,550.

(30) Foreign Application Priority Data

Feb. 6, 1998 (JP) ..... 10-41372

(51) Int. Cl.[7] ..... A47B 97/00
(52) U.S. Cl. ..... 312/223.2; 349/58; 361/681
(58) Field of Search ..... 312/223.2, 7.2, 312/296, 208.3; 361/681, 682; 348/823, 824, 841; 349/58

(56) References Cited

U.S. PATENT DOCUMENTS

| | | | | |
|---|---|---|---|---|
| 4,779,025 | * | 10/1988 | Paynton et al. | 348/823 X |
| 5,335,076 | * | 8/1994 | Reh et al. | 348/823 X |
| 5,419,626 | * | 5/1995 | Crockett | 312/223.2 X |
| 5,479,285 | * | 12/1995 | Burke | 349/58 |
| 5,570,267 | * | 10/1996 | Ma | 361/681 |
| 5,586,002 | * | 12/1996 | Notarianni | 361/681 |
| 5,835,139 | * | 11/1998 | Yun et al. | 349/58 |

* cited by examiner

*Primary Examiner*—Peter M. Cuomo
*Assistant Examiner*—James O. Hansen
(74) *Attorney, Agent, or Firm*—Louis Woo

(57) ABSTRACT

A protective sheet mount structure for a display is provided which may be employed in electronic cash registers, for example. The structure includes a frame mount formed on a frame of a display around an opening through which a display screen is exposed, a protective sheet covering the display screen, and a sheet mount frame fitted in the frame mount detachably to retain the protective sheet on the frame of the display.

3 Claims, 11 Drawing Sheets

32
32A
32a
52
56
153
154
55
58
59
51
57
B
B

PROTECTIVE SHEET MOUNT STRUCTURE FOR DISPLAY

This application is a continuation of application Ser. No. 09/233,981 filed Jan. 20, 1999, now U.S. Pat. No. 6,152,550.

BACKGROUND OF THE INVENTION

1. Technical Field of the Invention

The present invention relates generally to a easy-to-replace protective sheet mount structure for a display which may be used in electronic terminal devices such as electronic cash registers.

2. Background Art

FIG. 22 shows a conventional electronic cash register which includes a display 60 and a key board 61. Data is inputted using the key board 61 and then indicated on the display 60.

The display 60 has a protective sheet 72 directly attached to a display screen thereof. It is, thus, difficult to replace the protective sheet 72. Such a structure also cannot keep free from mist of water to the display screen of the display perfectly.

SUMMARY OF THE INVENTION

It is therefore an object of the invention to provide an easy-to-replace protective sheet mount structure for a display which may be used in electronic terminal devices such as electronic cash registers.

It is another aspect of the invention to provide an improved protective sheet mount structure for a display designed to keep free from mist of water to a display screen.

According to one aspect of the invention, there is provided a display apparatus which comprises: (a) a casing having an opening formed therein; (b) a tough sensitive display installed in the casing with a touch screen exposed through the opening; (c) a frame mount provided on the casing around the opening; (d) a protective sheet covering the touch screen; and (e) a sheet mount frame fitted in the frame mount detachably to retain the protective sheet on the casing.

In the preferred mode of the invention, a sealing member is further provided which is disposed between the casing and the sheet mount frame around the opening.

The opening is of a rectangular shape. The frame mount is provided around right and left side portions and a lower portion of the opening and has recesses formed in right and left portions and a lower portion of the frame mount. The sheet mount frame is of a rectangular shape and has a slip-on rib formed on an upper edge thereof and protrusions formed on right and left side portions and a lower portion. The slip-on rib is fit on an upper edge of the opening of the casing. The protrusions engage the recesses of the frame mount to install the sheet mount frame on the frame mount.

A drain groove is formed in the frame mount around the opening outside the sealing member. A drain hole is formed in the drain groove for draining water entering the drain groove.

Right and left drain grooves may be formed which extend along right and left sides of the opening. A lower drain groove may be formed which extends along a lower portion of the opening and which leads to the right and left drain grooves. Right and left drain holes may be formed in the right and left drain grooves, respectively.

The frame mount is of a rectangular shape and has recesses formed on upper right and left side portions thereof.

The protective sheet is of a rectangular shape and has lugs formed on upper right and left side portions thereof and a step portion formed on a lower end portion thereof. The lugs are fitted in the recesses of the frame mount. The step portion is fitted on a lower edge of the opening of the casing.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiments but are for the purpose of explanation and understanding only.

In the drawings:

FIG. 3(*b*) is a partial view which shows a stay holder when a stay is moved downward;

FIG. 13(*b*) is a side view as viewed from E in FIG. 12;

FIG. 13(*c*) is a side view as viewed from F in FIG. 12;

DESCRIPTION OF THE PREFERRED EMBODIMENTS

Figure 1:
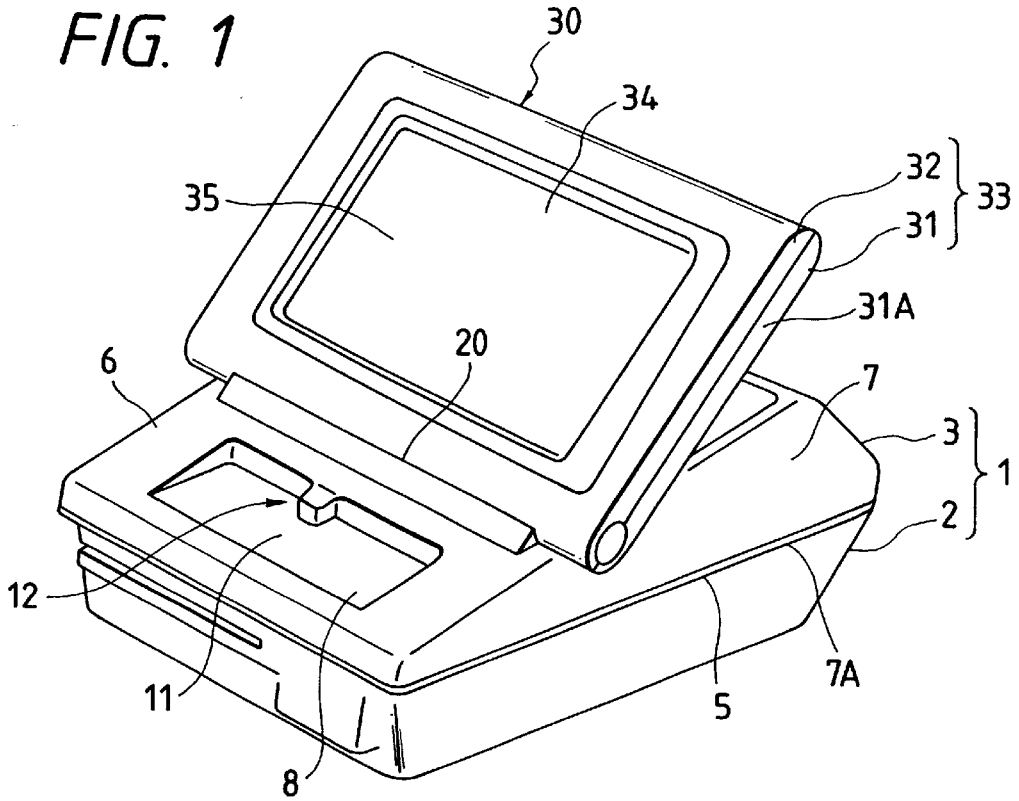
FIG. 1 is a perspective view which shows an electronic cash register with an easy-to-replace protective sheet replace structure according to the invention.

Referring now to the drawings, particularly to FIG. 1, there is shown an electronic cash register with an easy-to-replace protective sheet mount structure for a display according to the present invention.

The electronic cash register has a housing 1. The housing 1 consists of a lower casing 2 and an upper casing 3. The lower casing 2 has disposed therein a chassis mount (not shown) having the bottom in which an opening is formed. The lower casing 2 has an engaging portion 5 formed on an upper edge.

Figure 4:
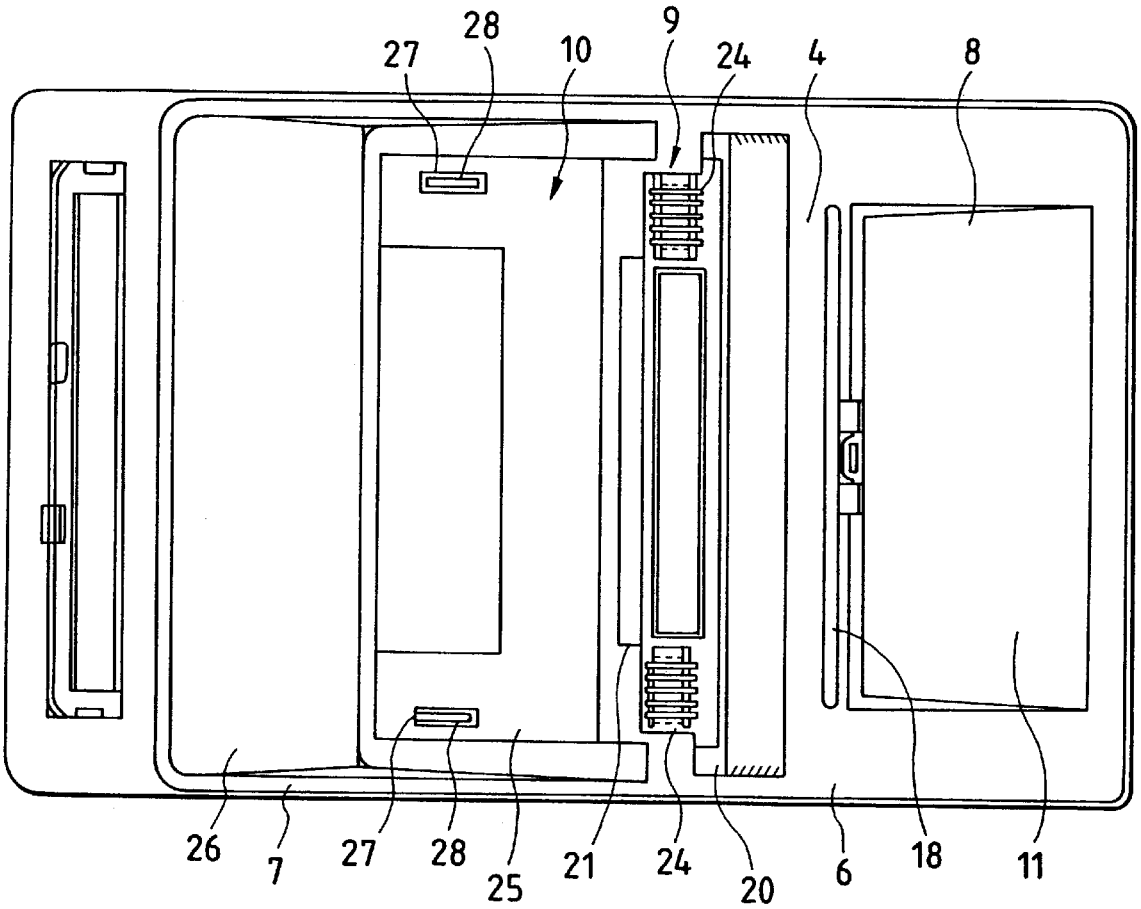
FIG. 4 is a top view of the electronic cash register in FIG. 1.
Figure 5:
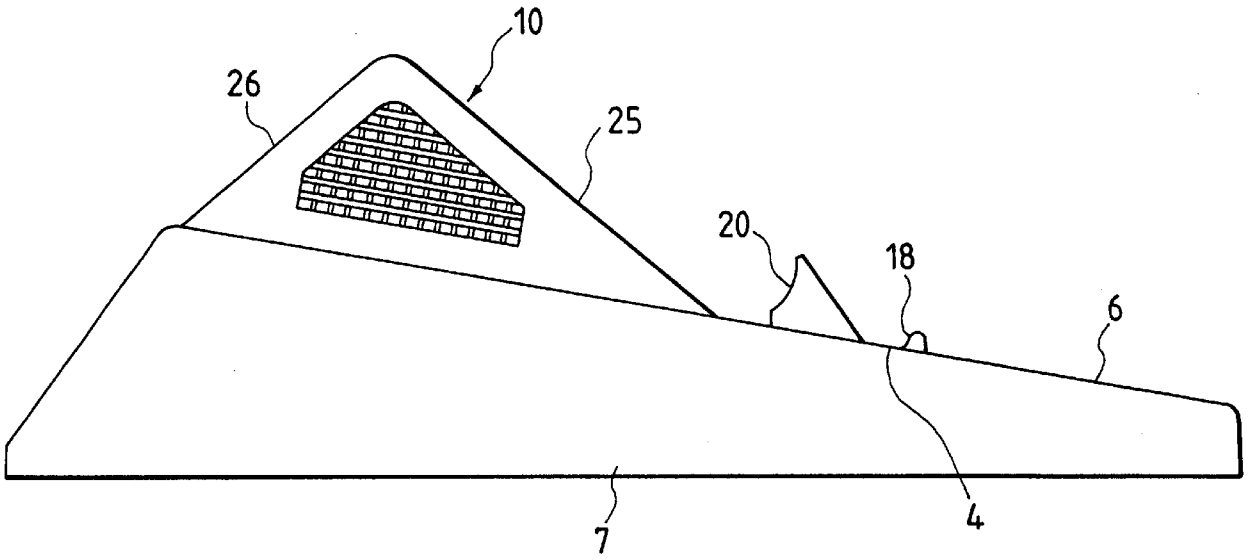
FIG. 5 is a side view which shows an upper casing of a housing of an electronic cash register.
Figure 6:
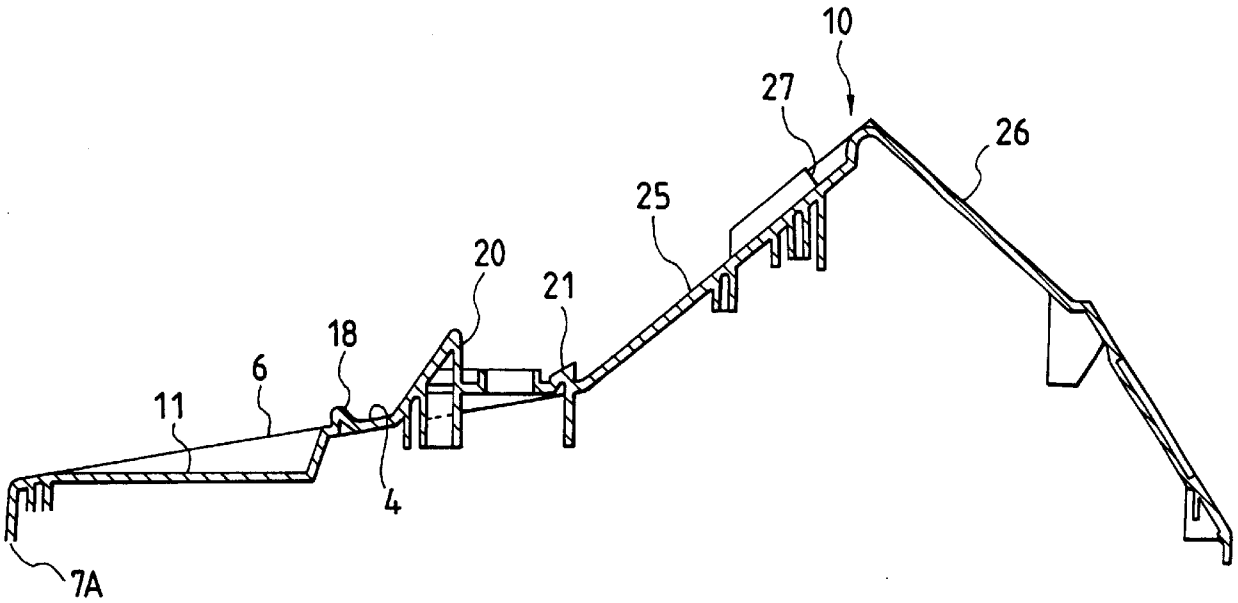
FIG. 6 is a longitudinal cross sectional view of the upper casing in FIG. 5.

The upper casing 3, as shown in FIGS. 4 to 6, includes an upper wall 6 and a side wall 7 surrounding the periphery of the upper wall 6. The side wall 7 has an engaging portion 7A formed on a lower edge thereof. The upper wall 6 has formed thereon a bill holder 8, a pen holder 4, a bearing assembly 9, and a display mount 10. The lower casing 2 and the upper casing 3 are joined in tight engagement of the engaging portions 5 with the engagement portion 7A.

Figure 7:
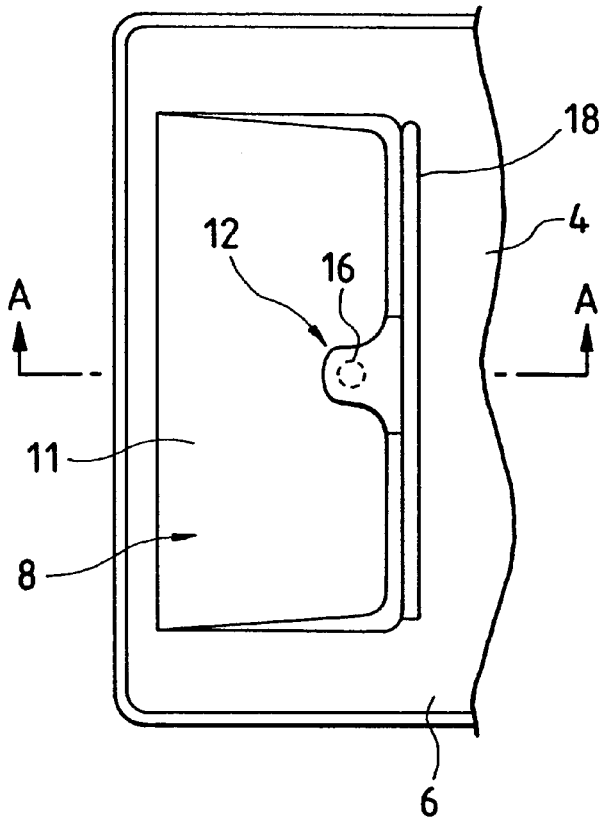
FIG. 7 is a partial plan view which shows a bill holder.
Figure 8A:
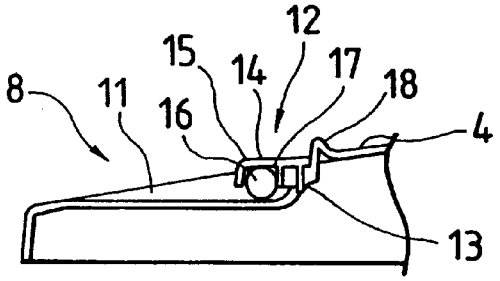
FIGS. 8(*a*) and 8(*b*) are partial cross sectional views taken along the line A—A in FIG. 7.
Figure 8B:
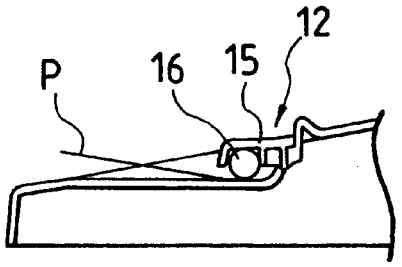

The bill holder 8, as clearly shown in FIGS. 7, 8(*a*), and 8(*b*), has a bill tray 11 formed with a flat recess. A bill holding mechanism 12 is disposed on the center of a rear end of the bill tray 11. The bill holding mechanism 12 includes a holder latch 13 formed on a rear wall of the bill tray 11, a gripper 14 secured detachably by the holder latch 13, a cushion plate 15 retained by the gripper 14, and a steel ball 16. The gripper 14 has formed therein a cushion chamber 17 in which the cushion plate 15 and the steel ball 16 are disposed. The cushion plate 17 produces elastic pressure urging the steel ball 16 into constant engagement with the bill tray 11, thereby allowing, as indicated by P in FIG. 8(*b*), a bill to be held between the bill tray 11 and the steel ball 16 tightly.

The upper wall 6 has the pen holder 4 formed behind the bill holder 8. The pen holder 4 is defined by a protrusion 18 extending in a width-wise direction of the upper wall 6 in parallel to the rear wall of the bill holder 8.

The bearing assembly 9 includes, as clearly shown in FIGS. 4 to 6, a front display mount protrusion 20, a rear display mount protrusion 21, and right and left bearings 24. The display mount protrusions 20 and 21 extend in the width-wise direction of the upper casing 3. The bearings 24 are installed between the display mount protrusions 20 and 21.

The display mount 10 includes a font slant wall 25 and a rear slant wall 26. Rectangular walls 27, as clearly shown in FIGS. 4 and 6, are formed on both sides of the front slant wall 25. The rectangular walls 27 have formed therein stay guide slots 28.

Figure 2:
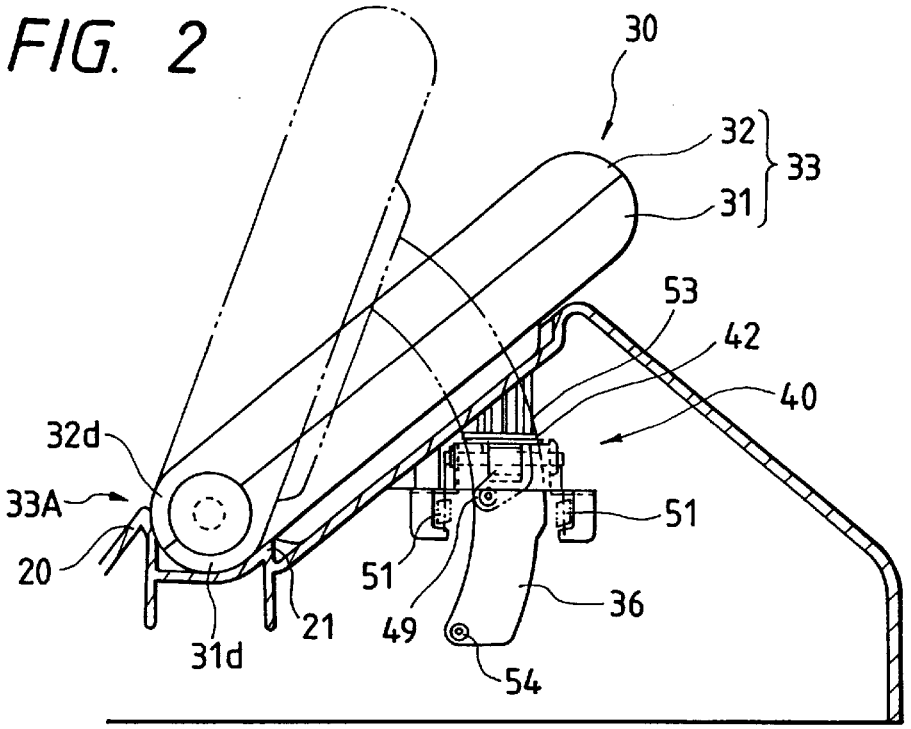
FIG. 2 is a partially cross sectional view which shows a display tilt adjusting mechanism.

The display 30 is, as shown in FIGS. 1 and 2, pivotably supported by the bearing assembly 9. The display 30 includes a casing 33 consisting of rear and front covers 31 and 32, a touch sensitive panel 34, and a protective sheet 35.

The rear cover 31 has a pair of cover bearings (not shown) mounted on right and left lower portions of an inner wall thereof. The cover bearings are arranged in alignment with the bearings 24 of the bearing assembly 9. A supporting shaft (not shown) is inserted through the cover bearings of the rear cover 31 and the bearings 24 of the bearing assembly 9 to support the rear cover 31 pivotably so that the display 30 may tilt back and forth (i.e., a lengthwise direction of the cash register) within a given angular range.

Figures 9, 10, 11:
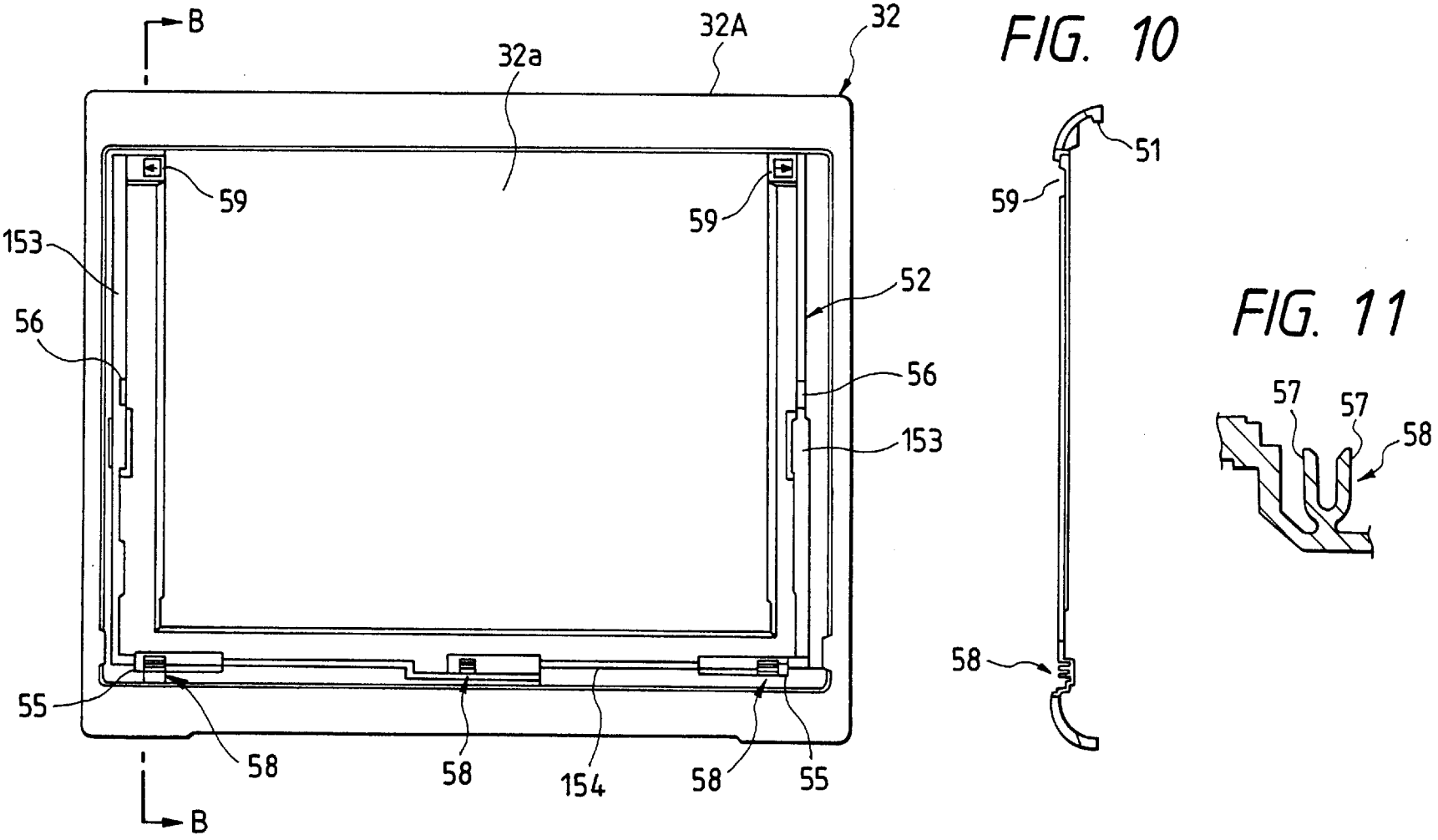
FIG. 9 is a plan view which shows a frame of a casing of a display.
FIG. 10 is a vertical cross sectional view taken along the line B—B in FIG. 9.
FIG. 11 is a partially cross sectional view which shows a sheet mount frame holder formed on the frame in FIG. 9.

The front cover 32 of the display 30, as shown in FIGS. 9 to 11, includes a rectangular frame 32A which has claws 51, as clearly shown in FIG. 10, formed on an upper, left, and right edges for attachment to the rear cover 31. The frame 32A has a frame mount 52 formed on right and left side surface and a lower surface thereof. The frame mount 52 has vertical drain grooves 153 formed in side portions thereof and also has a horizontal drain groove 154 formed in a lower portion thereof. The horizontal drain groove 154 leads to lower ends of the vertical drain grooves 153 and has drain holes 55 formed in ends thereof.

The vertical drain grooves 153 have recesses 56 formed in central portions thereof for attachment of a sheet mount frame 60, as will be described later in detail, to it. U-shaped holders 58, as clearly shown in FIGS. 9 and 10, are formed in ends and center of the lower portion of the frame mount 52. Each of the holders 58, as shown in FIG. 11, consists of a pair of claws 57. Sheet lug insertion recesses 59 are formed in upper ends of the side portions of the frame mount 52.

The rear cover 31 of the casing 33 has formed therein recesses for engagement with the claws 51 of the front cover 32. The casing 33 has disposed therein, as shown in FIG. 1, the touch sensitive panel 34 which has a touch screen on which a touch switch section and a display section are arranged adjacent to each other. The rear and front covers 31 and 32 have lower portions 31*d* and 32*d* curved to form a round bottom 33A of the casing 33. The round bottom 33A is placed between the front and rear display mount protrusions 20 and 21 in contact therewith.

A transparent protective sheet 35, as shown in FIG. 1, covers the touch screen of the touch sensitive panel 34 exposed through an opening 32*a*, as shown in FIG. 9, of the front cover 32 of the casing 33.

The sheet mount frame 60 is attached to the frame mount 52 to hold the protective sheet 35 tightly between the sheet mount frame 60 and the frame mount 52.

Figure 12:
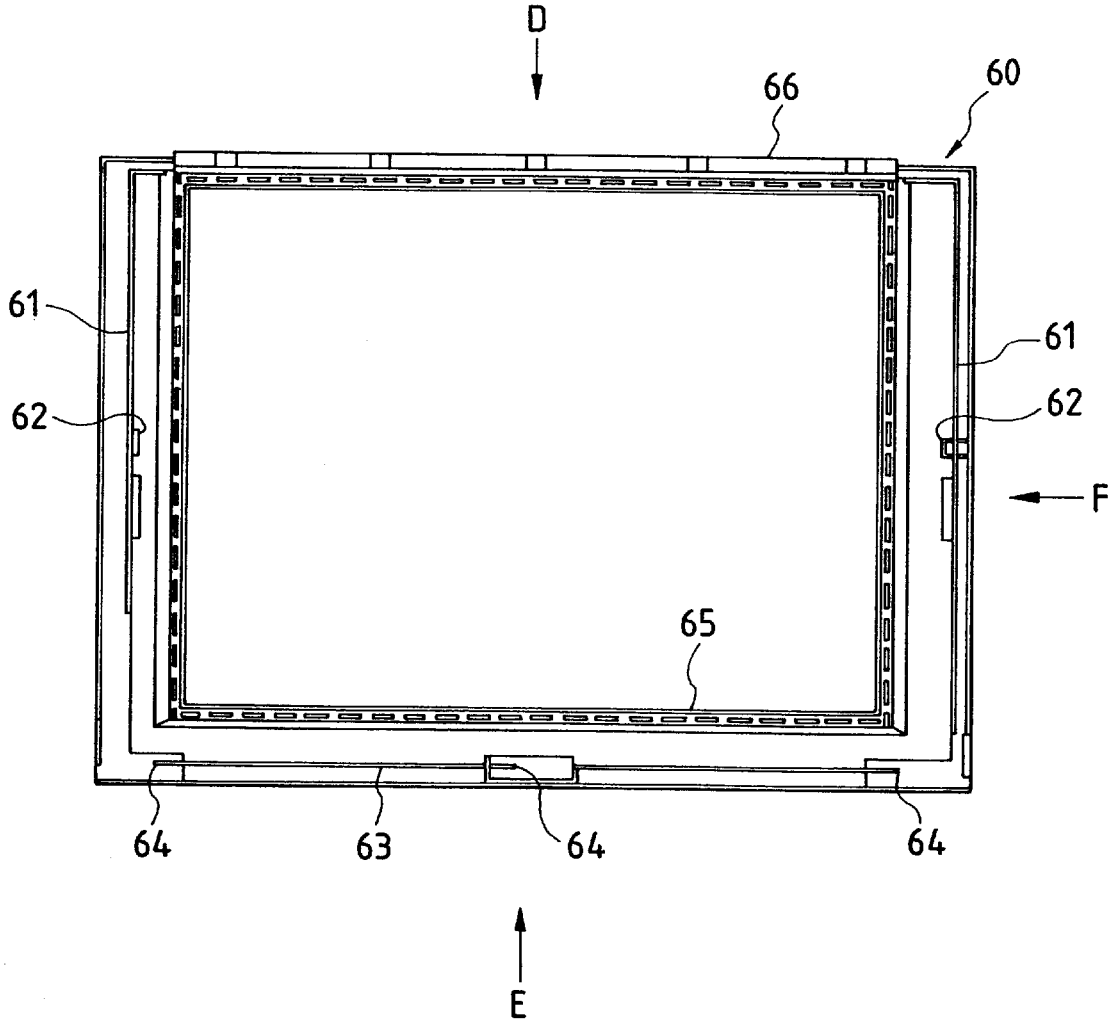
FIG. 12 is a plan view which shows a sheet mount frame for mounting a protective sheet on a casing of a display.
Figure 13A:
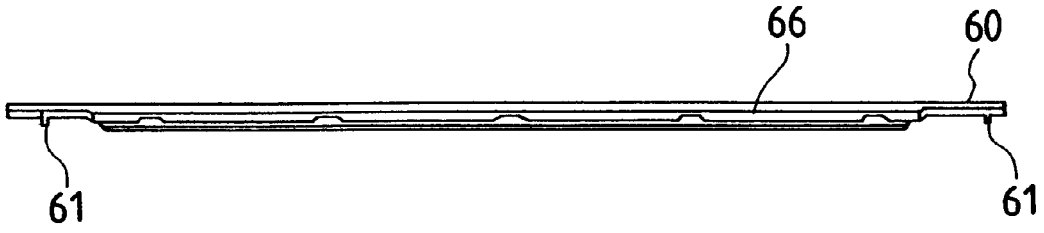
FIG. 13(*a*) is a side view as viewed from D in FIG. 12.
Figure 13B:
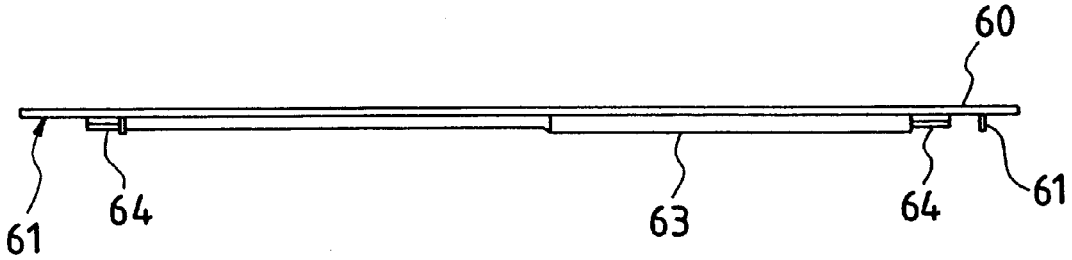
Figure 13C:
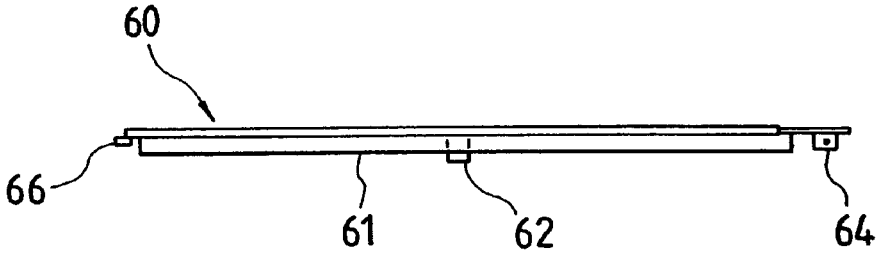

The sheet mount frame 60, as clearly shown in FIGS. 12 and 13(*a*), has vertical ribs 61 and claw-like protrusions 62 formed on sides of a rear wall thereof and also has a horizontal rib 63 formed on a lower end of the rear wall. The horizontal rib 63, as shown in FIGS. 12, 13(*b*), and 13(*c*), has barb-like protrusions 64 formed on ends and center thereof. The sheet mount frame 60 has a seal 65 attached to the rear wall around an opening thereof and also has a slip-on rib 66 formed on the upper portion thereof.

Figure 14:
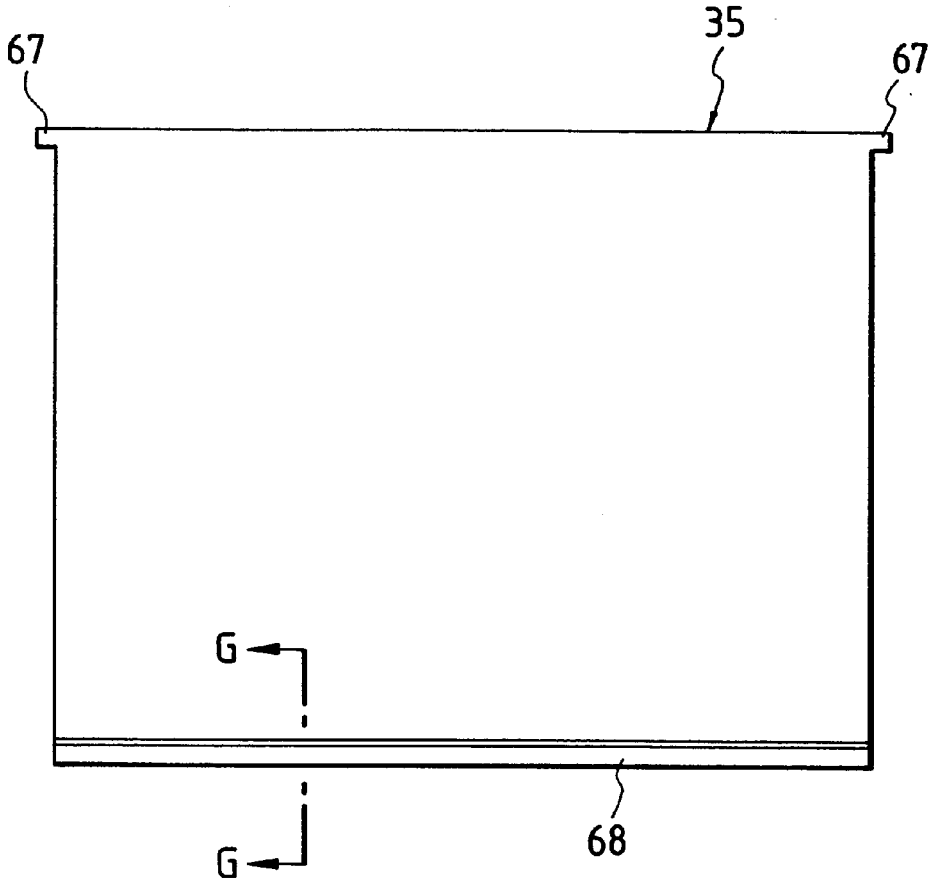
FIG. 14 is a plan view which shows a protective sheet.
Figure 15:
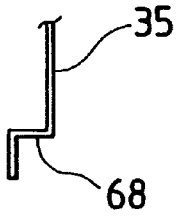
FIG. 15 is a partially cross sectional view taken along the line G—G in FIG. 14.
Figure 16:
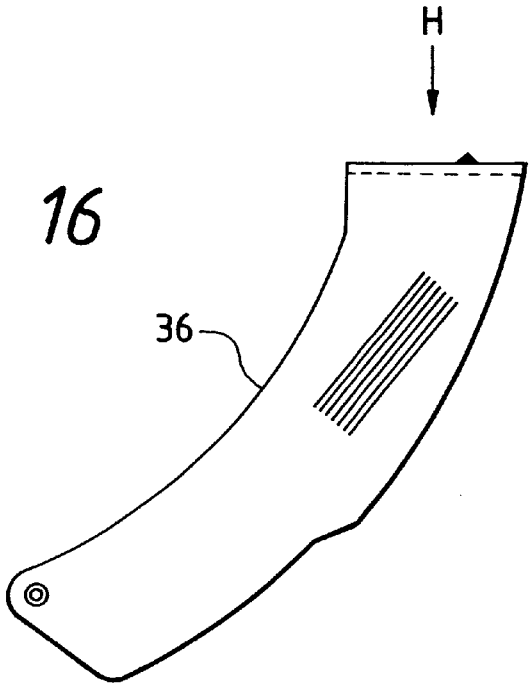
FIG. 16 is a side view which shows a stay supporting tilting motion of a display.

The protective sheet 35 has, as shown in FIG. 14, lugs 67 projecting from upper ends horizontally and also has, as shown in FIG. 15, a lower end bent to form a step 68. The lugs 67 are inserted into the sheet lug insertion recesses 59 of the frame 32A of the front cover 32. The step 68 is fit on an inner lower edge of the frame 32A. The sheet mount frame 60 is installed on the frame mount 52 by bringing the slip-on rib 66 of the sheet mount frame 60 into engagement with an inner upper edge of the frame mount 52 and forcing the claw-like protrusions 62 and the protrusions 64 into the recesses 56 and the holders 58, respectively, thereby attaching the protective sheet 35 to the frame 32A to cover the opening 32*a* of the frame 32A. The removing of the protective sheet 35 is achieved easily by reversing the above described operations.

The frame 32A has, as described above, the drain grooves 153 and 154 and the drain holes 55. Additionally, the sheet mount frame 60 has the seal 65 attached to the rear surface thereof which is held tightly between the sheet mount frame 60 and the protective sheet 35 on the frame 32A. If, therefore, drops of water are adhered on the front cover 32 around the opening 32*a*, most of them enter the drain grooves 153 or 154 and are drained from the drain holes 55. Even if drops of water are adhered inside the drain grooves 153 and 154, the seal 65 avoids intrusion of them into the casing 33.

Figure 17:
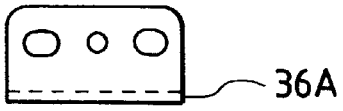
FIG. 17 is a top view as viewed from the direction H in FIG. 16.

A pair of stays 36 are installed at flanges 36A, as shown in FIG. 17, on right and left portions of an outer wall of the rear cover 31 using screws and inserted into the stay guide slots 28 formed in the display mount 10.

Figure 20:
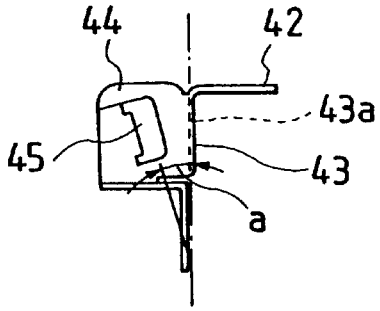
FIG. 20 is a side view as viewed from the direction I in FIG. 19.
Figure 21:
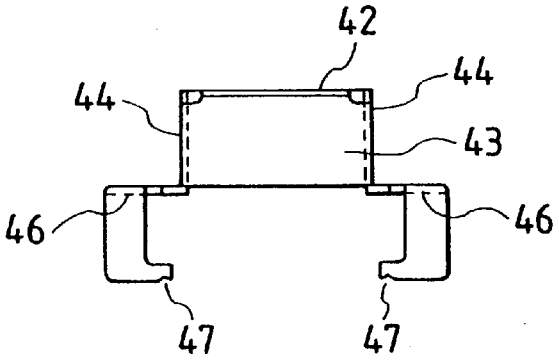
FIG. 21 is a front view as viewed from the direction J in FIG. 19.
Figure 22:
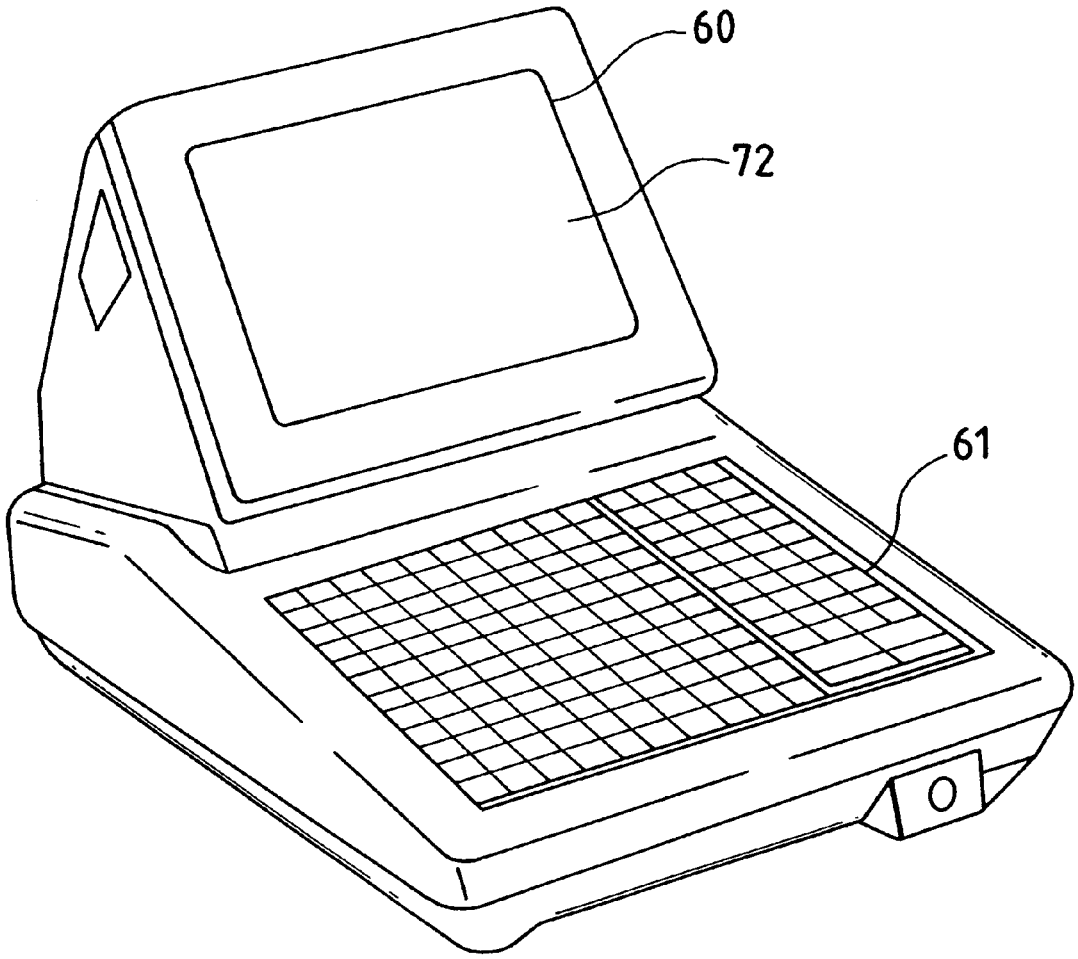
FIG. 22 PRIOR ART
FIG. 22 is a perspective view which shows a conventional electronic cash register.

A display tilt adjusting mechanism 40, as clearly shown in FIG. 2, which adjusts an angular position of the display 30, is disposed on an inner surface of the front slant wall 25 of the display mount 10. The display tilt adjusting mechanism 40 includes stay holders 41 each of which, as shown in FIGS. 19 to 23, has a plate 43 bent at right angles to a mount flange 42 having a mount hole 42*a* formed therein and a pair of shaft retainers 44 bent at right angles to both sides of the plate 43. The shaft retainers 44 each have, as shown in FIG. 20, formed therein an elongated hole 45 which extends with an inclination of $\alpha$ (e.g., 15°) to the surface 43*a* of the plate 43. The shaft retainers 44 each have a mount plate 46 bent at right angles which has formed thereon a spring hook 47.

Figure 3A:
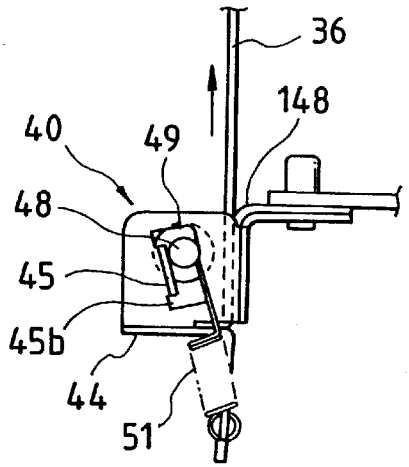
FIG. 3(*a*) is a partial view which shows a stay holder when a stay is moved upward.
Figure 3B:
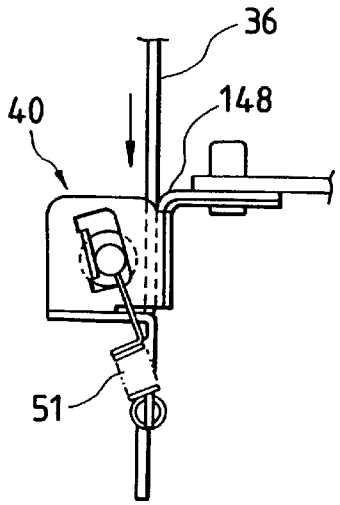
Figure 18:
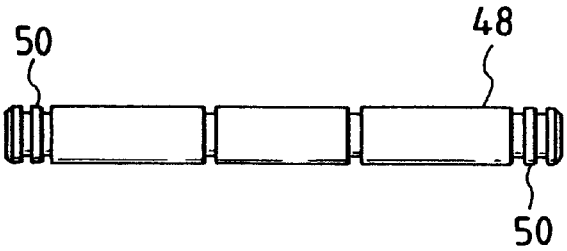
FIG. 18 is an illustration which shows a support shaft installed in a stay holder.
Figure 19:
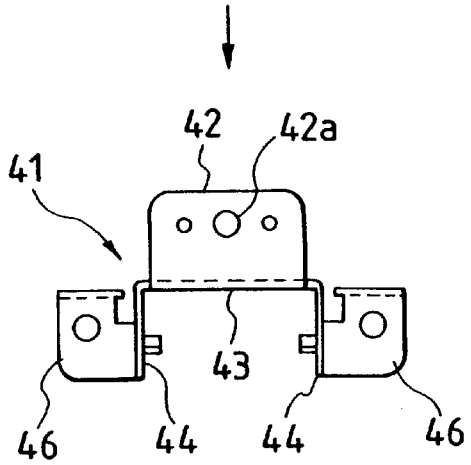
FIG. 19 is a plan view which shows a stay holder.

A resinous sliding plate 148 is, as shown in FIGS. 3(*a*) and 3(*b*), attached to the surface 43*a* of the plate 43 for facilitating ease of movement of the stay 36. A support shaft 48, as shown in FIGS. 2, 3(*a*), 3(*b*), and 18 is inserted through the elongated holes 45 of the shaft retainers 44 so as to be movable in a lengthwise direction of the elongated holes 45. The support shaft 48 has a roller 49 wound therearound. The support shaft 48, as shown in FIG. 18, has formed in ends thereof grooves 50. Coil springs 51 are hung at one end on the grooves 50 of the support shaft 48 and at the other end on the spring hooks 47 of the mount plates 46, respectively, to elastically urge the support shaft 48 to lower ends 45*b* of the elongated holes 45 to bring the roller 49 into engagement with the sliding plate 48.

The display tilt adjusting mechanism 40 thus constructed is disposed in the upper casing 3 with the mount flanges 42 of the stay holders 41 secured using screws on a mount block 53, as shown in FIG. 2, formed on the inner wall of the upper casing 3. Each of the stays 36 extending through one of the stay guide slots 28 inward of the upper casing 3 passes through a nip formed by the roller 49 and the sliding plate 48 of one of the stay holders 41. Each of the stays 36 has disposed on an end a stopper 54, as shown in FIG. 2, which is made of a protrusion for avoiding dislodgement of the stay 36 from the stay holder 41.

In operation, when it is required to tilt the display 30 frontward, an operator pulls the display 30 manually. This causes, as shown in FIG. 3(*a*), each of the stays 36 to be moved upward, thereby lifting up the roller 49 slightly which is pressed against the stay 36, so that the support shaft 48 is moved upward against the spring pressure of the coil spring 51 along the elongated hole 45. The elongated hole 45 is, as described above, oriented at the angle a to the surface 43*a* of the plate 43. The upward movement of the support shaft 48, thus, causes the roller 49 to move into disengagement from the surface of the stay 36, thereby releasing the stay 36 from the nip formed by the roller 49 and the sliding plate 148, which allows the display 30 to be tilted frontward smoothly.

When the tilting motion of the display 30 is stopped by the operator, it will cause the support shaft 48 of each of the stay holders 41 to be urged downward by the spring pressure of the coil spring 51 to press the stay 36 against the sliding plate 48 to lock the stay 36, so that the display 30 is held at a desired angle.

When it is required to tilt the display 30 backward, the operator pushes the display 30 manually. This causes the stays 36 to be moved downward. The downward movement of each of the stays 36 increases the nip provided by the roller 49 and the sliding plate 148. When the operator pushes the display 30 with pressure greater than the nips of the stays 36, each of the stay 36, as clearly shown in FIG. 3(*b*), slides downward along the sliding plate 148. When the operator stops pushing the display 30, the display 30 is held at a desired angle.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A display apparatus comprising:

a casing having an opening formed therein;

a touch sensitive display installed in said casing with a touch screen exposed through the opening;

a frame mount having at least two recesses provided on the casing around the opening, said two recesses being provided at opposed portions of said frame mount, at least on holder being provided at a portion between the opposed portions of said frame mount;

a non-polarizing protective sheet covering the touch screen; and a sheet mount frame having a plurality of protrusions detachably fitted to said frame mount by mating respective one of said protrusions to said recesses and said holder to thereby enable said protective sheet to be retained on said casing and yet be readily removed therefrom.

2. A display apparatus as set forth in claim 1, further comprising a sealing member disposed between said casing and said sheet mount frame around the opening.

3. A display apparatus as set forth in claim 1, wherein said frame mount is a rectangular shape and has said recesses formed on upper right and left side portions thereof and wherein said protective sheet is of a rectangular shape and has lugs formed on upper right and left side portions thereof and a step portion formed on a lower end portion thereof, the lugs being fitted in the recesses of said frame mount, the step portion being fitted on a lower edge of the opening of said casing.

* * * * *